US008991636B2

(12) United States Patent
Verhulst et al.

(10) Patent No.: US 8,991,636 B2
(45) Date of Patent: Mar. 31, 2015

(54) WEB INSULATION SYSTEM, VALVE FOR A WEB INSULATION SYSTEM, AND A STORAGE CONTAINER USING THE WEB INSULATION SYSTEM

(71) Applicant: Board of Trustees of Northern Illinois University, DeKalb, IL (US)

(72) Inventors: Michael Wallace Verhulst, Springfield, IL (US); Joseph D. Nix, Fort Wayne, IN (US); Christopher W. Smith, Birmingham, AL (US)

(73) Assignee: Board of Trustees of Northern Illinois University, DeKalb, IL (US)

( * ) Notice: Subject to any disclaimer, the term of this patent is extended or adjusted under 35 U.S.C. 154(b) by 0 days.

(21) Appl. No.: 13/837,369

(22) Filed: Mar. 15, 2013

(65) Prior Publication Data

US 2014/0263355 A1 Sep. 18, 2014

(51) Int. Cl.

| | |
|---|---|
| ***F17C 13/00*** | (2006.01) |
| ***F17C 13/08*** | (2006.01) |
| *F17C 3/02* | (2006.01) |

(52) U.S. Cl.

CPC ..... *F17C 13/001* (2013.01); *F17C 3/02* (2013.01); *F17C 13/08* (2013.01)

USPC ..... 220/560.1; 220/23.89

(58) Field of Classification Search

CPC ..... F17C 3/085; F17C 3/08; F17C 3/02; F17C 13/086; F17C 2203/014; F17C 2203/01; F17C 2203/0391; F17C 2203/03

USPC ..... 220/560.1, 560.14, 560.12, 589, 588, 220/586, 62.19, 62.18, 23.89; 206/0.6

See application file for complete search history.

(56) References Cited

U.S. PATENT DOCUMENTS

| | | | | |
|---|---|---|---|---|
| 872,795 | A | 12/1907 | Burger | |
| 3,115,983 | A * | 12/1963 | Wissmiller | 220/560.1 |
| 3,228,187 | A * | 1/1966 | Escher | 60/267 |
| 3,335,904 | A * | 8/1967 | Anderson | 220/645 |
| 3,713,560 | A | 1/1973 | Slysh et al. | |
| 3,909,225 | A | 9/1975 | Rooney | |
| 3,948,406 | A | 4/1976 | Papanicolaou et al. | |
| 4,557,297 | A | 12/1985 | Montana | |
| 4,992,623 | A | 2/1991 | Briley et al. | |
| 5,020,358 | A * | 6/1991 | Sharp | 73/49.2 |
| 5,026,681 | A | 6/1991 | Hed | |
| 5,167,142 | A * | 12/1992 | Sharp | 73/49.2 |
| 5,553,734 | A * | 9/1996 | Sharp | 220/567.1 |
| 5,558,919 | A | 9/1996 | Toni et al. | |
| 5,590,054 | A | 12/1996 | McIntosh | |
| 5,597,009 | A | 1/1997 | Scherrer et al. | |
| 6,341,624 | B1 | 1/2002 | Nelson et al. | |
| 6,363,597 | B1 * | 4/2002 | Markhoff et al. | 29/403.1 |
| 6,403,182 | B1 | 6/2002 | Plummer et al. | |
| 6,708,502 | B1 * | 3/2004 | Aceves et al. | 62/45.1 |
| 7,156,364 | B2 | 1/2007 | Berghoff | |
| 7,640,620 | B2 | 1/2010 | Stockton | |

(Continued)

*Primary Examiner* — Robert J Hicks

(74) *Attorney, Agent, or Firm* — Drinker Biddle & Reath LLP

(57) ABSTRACT

A storage system, including an outer casing having an evacuated inner volume; a vessel for storage located within the outer casing and having a plurality of protrusions distributed on an outer surface thereof; and a plurality of filamentary strands spanning the inner volume, wherein at least some of the plurality of protrusions are essentially tangentially contacted by a plurality of the filamentary strands to secure the vessel in six degrees of freedom relative to the outer casing.

7 Claims, 11 Drawing Sheets

(56) References Cited

U.S. PATENT DOCUMENTS 7,686,017 B2 3/2010 Taylor
7,717,291 B2 5/2010 Stuhmer
2009/0152278 A1* 6/2009 Lindner ..... 220/589

* cited by examiner

WEB INSULATION SYSTEM, VALVE FOR A WEB INSULATION SYSTEM, AND A STORAGE CONTAINER USING THE WEB INSULATION SYSTEM

FIELD OF THE INVENTION

The present invention is related to insulation systems and devices to contain, insulate, and transport matter that is required to be kept at low temperatures, or otherwise thermally isolated, such as cold liquids, superfluids, and cryogens.

DISCUSSION OF THE BACKGROUND

The most commonly used device to contain and insulate cryogens today is called a Dewar or vacuum flask. These devices are made by taking a single piece of metal, forming it into a cylinder and then with the same piece of metal forming a smaller cylinder inside the other cylinder. The purpose of this is to maximize the length thermal energy has to conduct through the curved piece of metal to get to the cryogen, with the only thermal conductivity being located around the lip of the container, usually the bottleneck. Some of these flasks use standoffs or metallic webs in a lower section of the cylinder away from the lip that provides for additional mechanical support of the smaller cylinder inside the larger one, instead of having the inner part of the flask being held solely by the lip. An example of such vacuum flasks is described in U.S. Pat. No. 872,795, issued in the year 1907.

This type of insulation system can be made very structurally sound, but only at the cost of severely increasing its thermal conductivity. Or, conversely, as is the case with most insulation systems, it can be made to better insulate but at a high cost to the structural integrity. The vacuum flask is the most common type of insulation system in use today. This is because it is a cheap way of insulating liquids in a design that can be easily manufactured, and is relied upon to store and transport most cryogens for relatively short periods of time. To allow for a cryogen to stay at the appropriate temperature for longer periods of time, active cooling systems are often used in addition to the Dewar insulation systems, in order to compensate for the quite significant heat leakages. Though this system is the most widely used, it is the standard minimum thermal insulator for most applications. It can often be used in conjunction with other systems.

Another common insulation system is multi-layered insulation (MU) system. MLI is composed of many layers of metal coated plastic sheets, all of very small thickness. Its operating mechanism is slowing down thermal transport by adding many different layers radiation must hit, before being reemitted. In order to be effective, MLI must as completely as possible cover what it is insulating, in order to shield it from radiation. This system is only of use when thermal transport through radiation dominates thermal transport through conduction or convection. For this reason, it is rarely used, as it is only needed in a few specialized circumstances, where conduction or convection is negligible. These could include uses in outer space such as satellites, other spacecraft, or inside or around vacuum flasks, to further insulate. However, the MLI systems are very fragile, giving next to no practical support to what it is insulating. It also has a comparable thermal conductivity to that of the above described vacuum flask.

A third less sophisticated in a sense, method of insulating a material is to simply surround it by another material that has a low thermal conductivity, such as plastics, Styrofoam™, Kevlar™, Mylar™, Kapton™, Aerogel, heat shield tiles, wood, other hot materials, other cryogens, pockets of air, and pockets of vacuum, carbon-carbon composites, glass, newspaper or other housing insulation, or asbestos. These other systems are often not comparable to the aforementioned solutions, neither structurally nor thermally, but occasionally offer very specific and desired combinations of thermal and structural properties. An example of such an insulation system is the tiles on the Space Shuttle. Furthermore, any number or combination of the above conventional devices can, and many have, been used together, or in combination. A few notable examples include, Layered Dewars (Dewars inside Dewars), Layered Dewar containing progressively colder cryogens, and Dewars layered with other insulation system such as MLI.

However, for many applications, the existing insulation systems designs are ineffective and insufficient for their requirements, because they are physically and structurally weak or would have a relatively high thermal conductivity, or both. For example, a physically and structurally weak system is undesirable and not suitable for application that are subjected to very high level of stress, forces, accelerations, very high vibrations and jerks, for example, in aerospace and aviation applications. Forces and stresses resulting from environmental conditions could damage or destroy the insulators of many existing systems. For many applications, very high thermal resistance is required so that the system is uncommonly insulative, especially if cryogenic liquids need to be transported and handled for longer time periods, at critical temperatures very near absolute zero. In such applications, any extra heat that reaches a storage tank can destroy the cryogen by evaporating it, and potentially damaging other devices. Even some of the best insulators that are currently available have severe limitations in many aspects, because the cryogen would heat up to fast and consequently phase change into a gas. Some existing insulation systems may provide for mechanical and structural strength, but are heavy and have poor thermal insulation. Also, due to poor insulation properties of cryogenic tanks for storage and transportation, a time period for using cryogen is so short that it entails significant impediments to the storage, use, supply, creation, and transport of cryogens.

Therefore, although there has been some advancements in the field of insulation systems, there is still a need for improved insulation systems having low weight, high mechanical strength, and excellent heat insulation capabilities.

SUMMARY

According to a first aspect of the present invention, a storage system is provided. The storage system preferably includes an outer casing having an evacuated inner volume, and a vessel for storage located within the outer casing and having a plurality of protrusions distributed on an outer surface thereof. Moreover, the storage system also preferably includes a plurality of filamentary strands spanning the inner volume, wherein at least some of the plurality of protrusions are essentially tangentially contacted by a plurality of the filamentary strands to secure the vessel in six degrees of freedom relative to the outer casing.

According to another aspect of the present invention, a valve for a storage system is provided. The valve preferably includes a flexible, non-creasing tube, wherein a first end of the tube is in fluid communication with an interior of a storage vessel and a second of the tube is in fluid communication with atmosphere; and a lattice structure including an upper structure and a lower structure, wherein the upper structure and the lower structure move relative to each other to form an area contacting region therebetween. In addition, preferably the tube runs through the area contacting region of the lattice structure, and the relative motion of the upper structure and the lower structure controls an open-closed condition of the valve by contacting the tube with an area contact to bias a closed position and by removing the area contact to bias the open position.

Moreover, according to yet another aspect of the present invention, a thermal insulation device is provided. The thermal insulation device includes an outer shell exposed to an exterior area, a storage container located inside the outer shell, and a substantially vacuumized area between the outer shell and the storage container. Moreover, the thermal insulation device further preferably includes suspended filamentary strands located inside the vacuumized area, each filamentary strand having a first end and second end. In addition, preferably the first end and the second end of each filamentary strand is attached to an inner side of the outer shell to be suspended such that each filamentary strand holds the storage container at a fixed position.

BRIEF DESCRIPTION OF THE SEVERAL VIEWS OF THE DRAWINGS

These and other aspects and features of embodiments of the present invention will be better understood after a reading of the following detailed description, together with the attached drawings, wherein.

Similar reference characters denote corresponding features consistently throughout the attached drawings. The drawings are not intended to be depicted in scale, but are merely illustrative to show the embodiments of the present invention.

DETAILED DESCRIPTION OF THE EMBODIMENTS

The present invention now is described more fully hereinafter with reference to the accompanying drawings, in which embodiments of the invention are shown. This invention may, however, be embodied in many different forms and should not be construed as limited to the embodiments set forth herein; rather, these embodiments are provided so that this disclosure will be thorough and complete, and will fully convey the scope of the invention to those skilled in the art.

Figure 1:
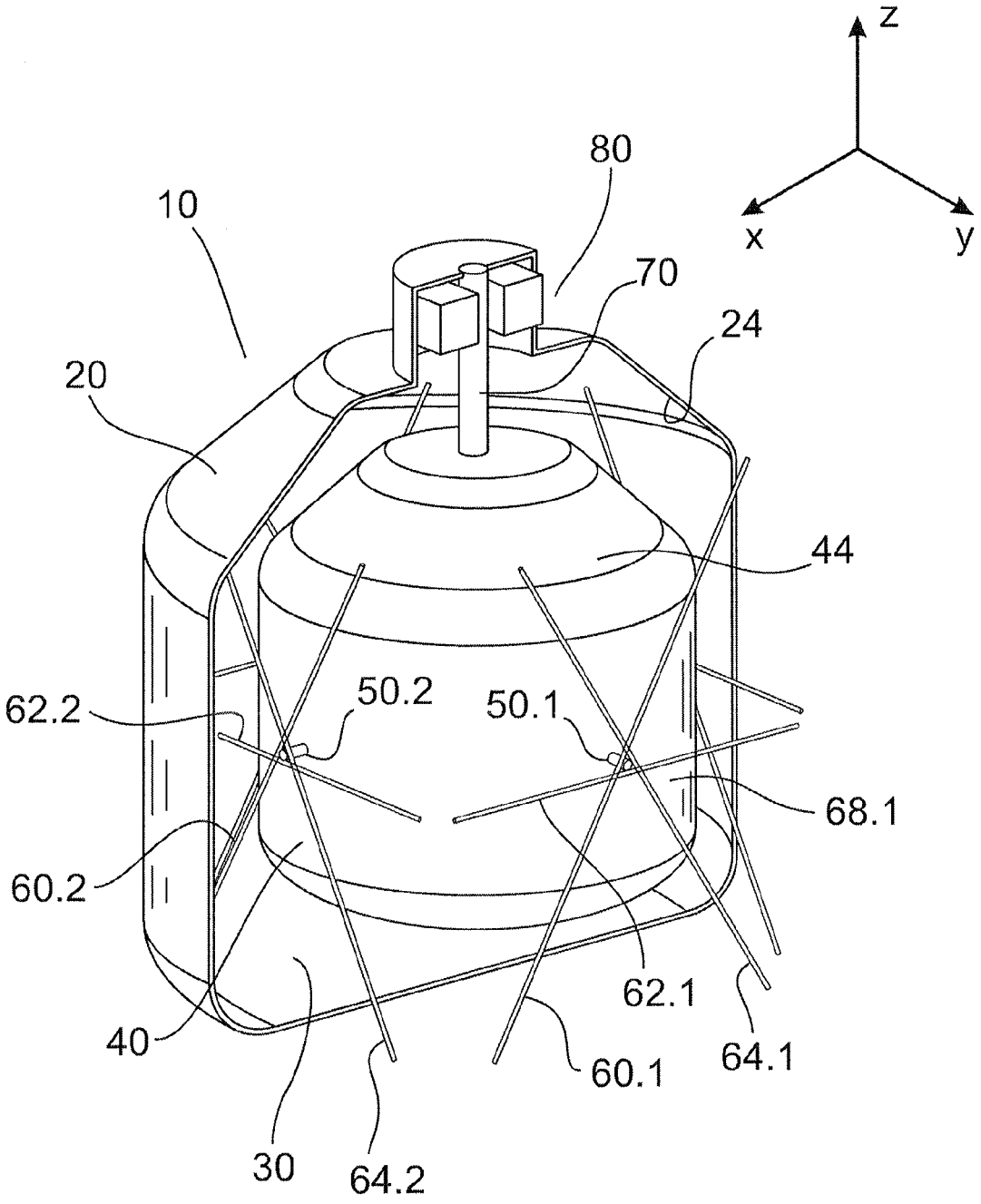
FIG. 1 shows a perspective schematic cut out view of a storage container using the web insulation system according to a first embodiment.

A first embodiment of the web insulation system is shown with respect to FIG. 1, in as a part of a storage container 10. A reference Cartesian coordinate system is given for descriptive and reference purposes only. FIG. 1 depicts a storage container 10 having an outer casing 20 with an evacuated inner volume 30, and a vessel 40 for storage located within outer casing 20 and having a plurality of protrusions 50.1, 50.2, etc. that laterally protrude from an outer surface 44 of vessel 40. In the variant shown, protrusions 50.1, 50.2 are attached at four different locations around a cylindrical-shaped side wall of the outer surface 44, and are protruding away in a radial direction perpendicular to the outer surface 44. Protrusions 50.1, 50.2 themselves have a cylindrical shape, and arranged such that they only protrude partially into inner volume 30 between outer surface 44 of vessel 40 and inner surface 24 of outer casing 20. Protrusions 50.1, 50.2 do not touch the inner surface 24 of outer casing 20. For each protrusion 50.1, 50.2 arranged on outer surface 44, at least three filamentary strands 60.1, 62.1, 64.1, or 60.2, 62.2, 64.2, preferably made from Kevlar™ or from Basalt fiber strands, are arranged to tangentially contact an outer surface of corresponding protrusions 50.1, 50.2 from three different angles, such that the filamentary strands are substantially rotational-symmetric. The filamentary strands are tensioned or suspended by attachment to inner surface 24 of outer casing 20. The container 10 is manufactured such that the inner volume 30 is vacuumized, for example by manufacturing the container 10 in a vacuum environment, or by special vacuumization techniques of inner volume 30, providing a barrier to substantially any thermal transfers.

Figure 2:
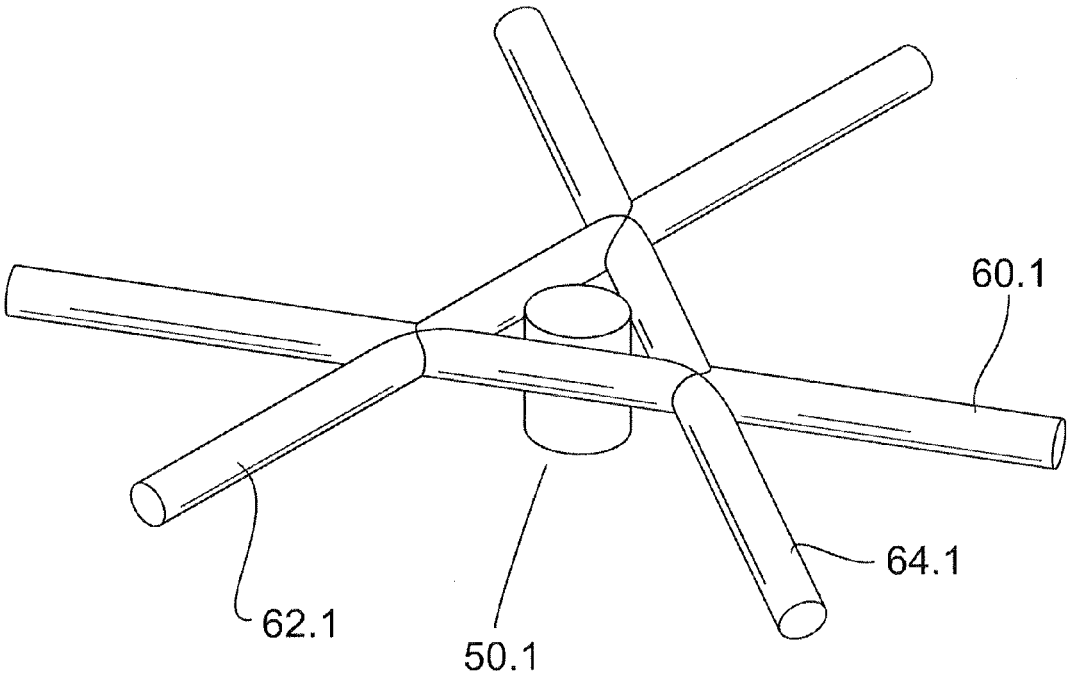
FIG. 2 shows a close-up view of a triangle formed by the filamentary strands arranged around a protrusion according to the first embodiment.

The ends of the filamentary strands 60.1, 62.1, 64.1, 60.2, 62.2, 64.2 are attached to inner surface 24 of outer casing 20, at upper and lower sections of outer casing 20, respectively. As further depicted in FIG. 2, a group of three strands 60.1, 62.1, 64.1 or, 60.2, 62.2, 64.2 is associated with a protrusion 50.1 or 50.2, respectively, and is arranged to form a triangle 68.1 or 68.2 substantially at the center of each strand 60.1, 62.1, 64.1 or 60.2, 62.2, 64.2 around corresponding protrusion 50.1, 50.2 so that protrusion 50.1 or 50.2 is held at a fixed position by strands 60.1, 62.1, 64.1, or 60.2, 62.2, 64.2 along any direction of a plane that is formed by strands 60.1, 62.1, 64.1, or 60.2, 62.2, 64.2. If these three strands are held sufficiently tight, not only can they prevent most motion from the protrusion in any direction toward a strand 60.1, 62.1, 64, but also can absorb some mechanical vibrations. Although structural integrity is an important factor in this design, only three strands 60.1, 62.1, 64.1 are actually needed to fix protrusion 50.1 to be immobilized in any direction along the plane formed by strands 60.1, 62.1, 64.1. In a variant, it is also possible that the filamentary strands 60.1, 62.1, 64.1, 60.2, 62.2, 64.2 are not straight, but are tensioned partially around protrusion 50.1, 50.2, thereby changing the angle of direction with protrusion 50.1, 50.2, to provide for a tighter grip of strands with the corresponding protrusion.

In another variant, it is also possible that four or more filamentary strands are used to support each protrusion 50.1, 50.2, also arranged in a rotational-symmetric fashion. Groups of filamentary strands 60.1, 62.1, 64.1, or 60.2, 62.2, 64.2 are arranged around each protrusion in the fashion as explained above, forming planes that are arranged in different angles to each other, preferably the planes also being arranged rotational-symmetric, when viewed from the z-direction. In the embodiment shown in FIG. 1, four (4) different protrusions 50.1-50.4 are arranged around vessel 40, with four groups of filamentary strands, but in a variant there may be more than four groups arranged around vessel 40, arranged at different angles and positions. Also, it is possible that a group of strands and a corresponding protrusion 50.1-50.4 be arranged on a bottom wall vessel 40, the plane forms by strands arranged in the XY plane. Other arrangements of the strands are also within the scope of the invention, and it is possible that a group of strands and a corresponding protrusion 50.1-50.4 be arranged in any way to prohibit undesired motion of vessel 40.

Also with respect to FIG. 1, vessel 40 has a cylindrical shape with a conically shaped top portion that leads into a supply tube 70 that is arranged to lead through a valve system 80 arranged on an upper section of storage container 10. Valve system 80 can also be suspended inside outer casing by filamentary strands. Supply tube 70 is should be sufficiently small to allow for the space for the valve system 80 between the walls that form the neck of outer casing 20 and supply tube 70. Also, supply tube 70 is preferably thin-walled and have a certain length so that there is a minimal cross sectional area and increased length to conduct heat through, increasing its thermal resistance in a longitudinal direction of tube 70. Further, supply limited to Kevlar™, Kapton™, Tenon™, or Mylar™, is able to contain the working fluid without leaks or diffusion, and is able to be mechanically compressed at the working temperature without substantial amounts of damage from wear, as further discussed below. In addition, supply tube 70 is designed such that it reduces any thermal conductivity to a minimum without the need for structurally carrying or attaching vessel or tank 40 to the outer casing 20. By moving the load-bearing functionality to the groups of filamentary strands 60.1, 62.1, 64.1, or 60.2, 62.2, 64.2 and to the protrusions 50.1-50.4, the supply tube 70 does not have the requirement of being structurally important to holding the vessel 40. This allows the supply tube 70 to have substantially thinner walls, and potentially be made of weaker material, as compared to a solution where the supply tube is structurally carrying the tank, as seen in conventional vacuum containers.

Another aspect of the web insulation system used by container 10 is the strong reduction of thermal leakage paths and thermal leakage connections that have a very small cross sectional area and contact points by the use of a small number of Kevlar™ or Basalt fiber strands, or an equivalent material. For example, a surface of contact between the filamentary strands 60.1, 62.1, 64.1, or 60.2, 62.2, 64.2 with the respective protrusion 50.1 or 50.2 is as small as possible, preferably less than 10 $mm^2$, to reduce the potential thermal leakage connection between strands 60.1, 62.1, 64.1, or 60.2, 62.2, 64.2 and protrusion 50.1, 50.2. Therefore, the protrusions preferably have a cylindrical shape to minimize the contact surface with corresponding strands, though other geometries can be used, for example a triangular cross-section with the edges of the triangle being in contact with the strands. Also, preferably exactly three strands 60.1, 62.1, 64.1, or 60.2, 62.2, 64.2 are used to have the minimal amount of strands that allows to restrict any movement of protrusion 50.1 and 50.2 in a direction of a plane formed by strands 60.1, 62.1, 64.1, or 60.2, 62.2, 64.2, so that the contact surface to protrusions are minimized.

Moreover, strands 60.1, 62.1, 64.1, or 60.2, 62.2, 64.2 are preferably arranged so that the outer surface 44 of vessel 40 is not in contact with strands 60, 62, 64, and the strands 60.1, 62.1, 64.1, or 60.2, 62.2, 64.2 are only in contact with inner surface 24 of outer casing 20 at the connection points 22 and protrusions 50.1-50.4. Due to the high tensile strength, preferably having a yield strength higher than 1000 MPa, of the filamentary strands, a cross section of the strands is also chosen to be as small as possible, to further reduce a thermal leakage path from inside vessel 40 and the exterior area of casing 20, preferably in the range of 0.01 $mm^2$ to 10 $mm^2$, but is dependent on the structural requirements of holding the vessel 40. Because of these small connection points and thin filamentary strands and the arrangement of the components as described above, the thermal leakage paths of these strands are the only conduit for thermal conduction, and therefore the insulation will be substantially improved as compared to conventional insulator. Therefore, filamentary strands 60.1, 62.1, 64.1, or 60.2, 62.2, 64.2, are chosen to have a high length-to-diameter ratio, preferably in a range of 10-1000:1.

Figure 3A:
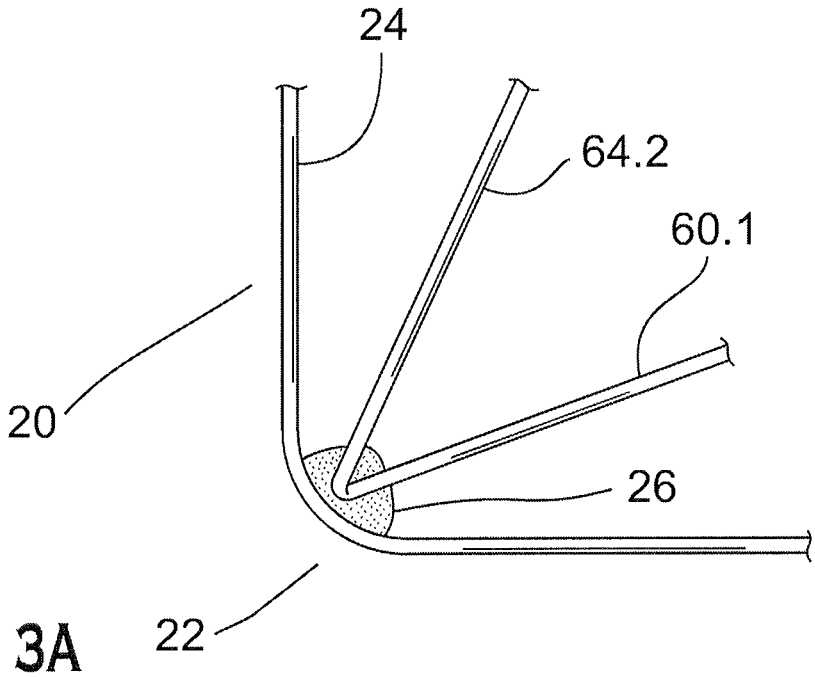
FIGS. 3A and 3B show different connections of the strands to the inner surface of outer casing.
Figure 3B:
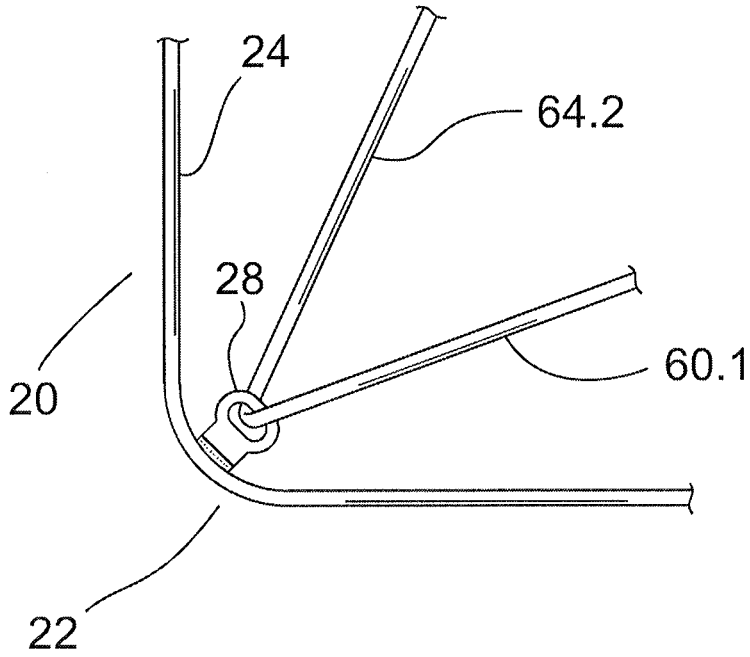

Another feature of the first embodiment shown in FIG. 1 is the fact that the connection points 22 that are located on inner surface 24 of outer casing 20 for each strand of a group of strands 60.1, 62.1, 64.1, or 60.2, 62.2, 64.2 share a common connection point with a strand of an adjacent group, as also shown in FIGS. 3A and 3B. For example, strand 64.2 share a lower connection point with strand 60.1, and horizontal strand 62.2 shares its right connection point with strand 62.1. This allows a design with the overall surface of contact with inner surface 24 being smaller. Moreover, the connection points of strands 60.1, 62.1, 64.1, 60.2, 62.2, 64.2 are attached to surface 24 without damaging any of the mechanical integrity of outer casing 20. Typically, strands 60.1, 62.1, 64.1, 60.2, 62.2, 64.2 are attached to casing 20 by an adhesive 26, such as an elastomeric urethane casting resin, by using an adhesive bonding method, as shown in FIG. 3A. Other adhesives 26 that can be used for this purpose are nylon-phenolic, nitrile-phenolic, nitriles, neoprene, modified epoxy, cyanoacrylate, modified phenolic, resorcinol-formaldehyde, in particular if Kevlar™ strands are used. Also, in a variant, inner surface 24 of outer casing 20 can be prepared with a mechanical attachment device 28 or attaching the strands, without damaging the mechanical integrity for insulation of inner surface 24, for example, metallic hooks, rings, or pulleys. Pulleys could be brazed to the surface 24 at locations of attachment points for the strands 60.1, 62.1, 64.1, 60.2, 62.2, 64.2, as shown in FIG. 3B. If the mechanical attachment device 28 is made using pulleys, a single strand 60.1, 62.1, 64.1, 60.2, 62.2, 64.2 can be threaded through multiple pulleys, contacting multiple protrusions 50.1-50.4, and be tightened during assembly more easily.

The reduced contact surface between strands 60.1, 62.1, 64.1, 60.2, 62.2, 64.2 and protrusions 50.1, 50.2, the reduced cross sectional area of strands 60, 62, 64, and their high length-to-diameter ratio lends to very low thermal conduction. Moreover, the use of Kevlar™ as a material for strands 60.1, 62.1, 64.1, 60.2, 62.2, 64.2 having a high tensile strength is sufficient to support a wide range of central cryogen tank designs without the need for thicker strands for more mechanical stability. In the embodiment shown in FIG. 1, eight (8) filamentary strands of Kevlar™ are used, having eight (8) connection points that are common to adjacent group of strands. In this arrangement, vessel or central tank 40 is locked from all six (6) degrees of freedom, being the three perpendicular translations and three perpendicular rotations. Moreover, as an example, strands 60.1, 62.1, 64.1, 60.2, 62.2, 64.2 made of Kevlar™ can be used having a radius of about 0.7 mm and a corresponding cross sectional area of 3.079 $mm^2$, taking advantage of an estimated ultimate tensile strength of Kevlar™ being around 3000 MPa. Basalt fiber has similar tensile strength around 3000-4800 MPa. However, it is also possible to use thinner strands 60.1, 62.1, 64.1, 60.2, 62.2, 64.2 as discussed above, having strands made of Kevlar™ with a radius around 100 μM to be of sufficient strength to hold tank or vessel 40, depending on a volume, size, weight of vessel 40 and its contents. As an example, because a single strand of Kevlar™ having an excellent tear strength such that a Kevlar™ strand with the thickness of 0.2 mm can hold approximately 20 pounds before breaking, many strands would easily hold a 10 Liter tank of liquid nitrogen, at about 20 pounds. Thicker strands 60.1, 62.1, 64.1, 60.2, 62.2, 64.2 can be used if additional tensile strength is needed to suspend vessel 40 in casing 20 under strong vibrations, mechanical shock and other accelerations.

Figure 4A:
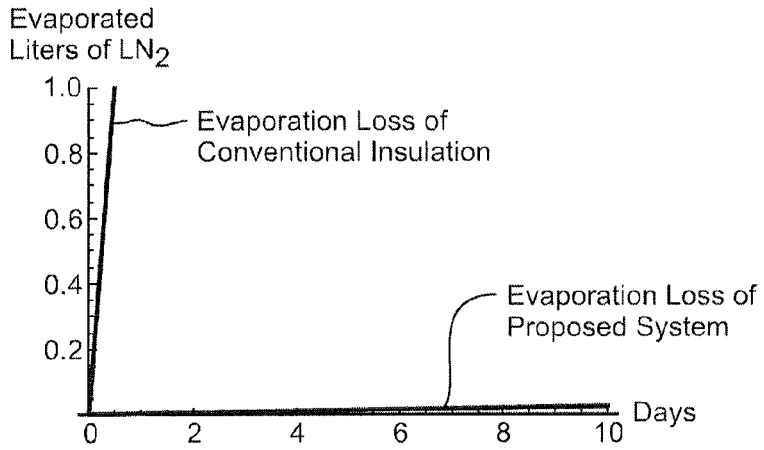
FIGS. 4A and 4B show graphs that depict evaporation of liquid nitrogen from a conventional tank as compared to an estimation of evaporation from container of the first embodiment.
Figure 4B:
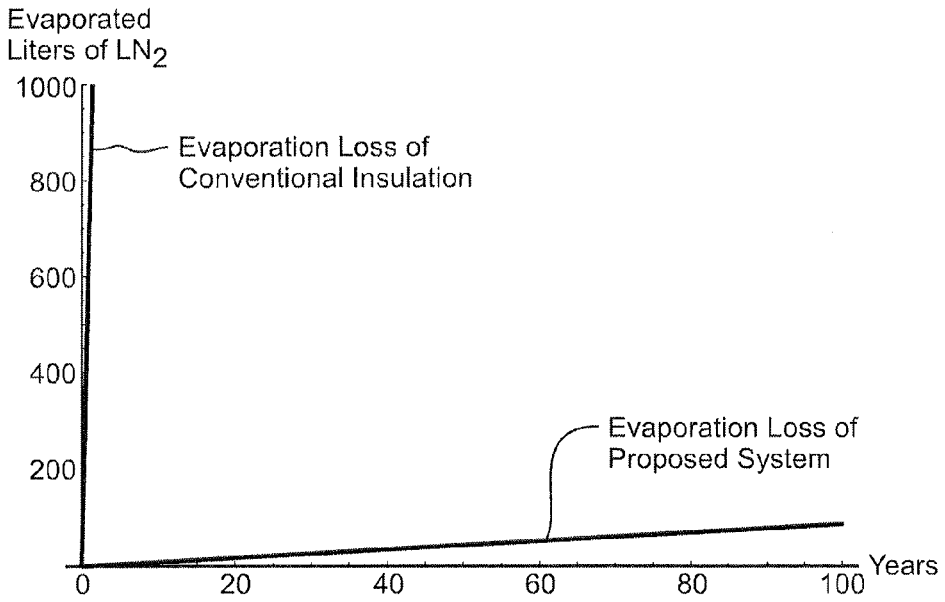

With the above discussed features, container 10 exhibits excellent thermal insulation characteristics. Numerical estimations of the thermal conductivity have been made based on thermal conductivity values of Kevlar™ at about 0.04 W/(m*K) and of Basalt fiber at about 0.035 W/(m*K), and in which one-dimensional thermal conduction formulas were summed representing the thermal throughput of the container, having a vessel or tank 40 designed to hold one (1) liter of liquid nitrogen ($LN_2$), having an upper bound of 4.36 mW, being container's total energy leak rate. This value appears to be about three (3) orders of magnitude smaller than average state of the art technology for cryogenic vacuum containers. One specific example are the cryogenic insulation systems from Sierra Lobo using multilayer insulation (MLI), these systems being designed for deep space missions where conserving cryogenic fuel is vital to satisfy mission parameters. The MLI-based system usually has a thermal throughput of about 4 W, about 1000 times greater than the estimates of the container 10 of the presented web insulation system suggests. FIGS. 4A and 4B depict a graph showing time versus evaporated volumes of $LN_2$ of between the Sierra Lobo MLI insulation system (steep line) and the container 10 of the present invention, showing a substantial improvement of container 10 of the conventional systems.

FIG. 4A depicts that a conventional container can lose a liter of cryogen in less than a day, while on the time scale of a week, the proposed container 10 would lose around a 1% of a liter. FIG. 4B illustrates the long term usefulness of the container 10 in that over the course of a hundred years only a 10% of a cubic meter of cryogen would be lost while a conventional container will lose a full cubic meter in a few years. These graphs therefore show that the container 10 can satisfy the most stringent requirements for maintaining long term operational conditions of cryogenic systems, such as long term storage at cryogenic temperatures in situations where no active cooling is possible, or no refueling of cryogens is possible, especially for space applications.

Also, container 10 proposes a design that is very sturdy, cost-effective, light-weight, and extremely thermally insulating. The filamentary strands can be made of very thin filaments of Kevlar that are light weight, and the multiple attachment points 22 and protrusions 50.1, 50.2 allow to have multiple mechanical support points spaced out equally around the vessel 40. This allows to reduce thicknesses of the materials used for vessel, and also the sturdiness of a neck or supply tube portion, as compared to a conventional design in which the only attachment point of vessel or tank to the outer casing 20 is via the neck or supply tube of tank. In addition, in light of the inherent flexibility of strands 60.1, 62.1, 64.1, 60.2, 62.2, 64.2, vibrations can be absorbed by the stands, and will avoid sudden or creeping breakage of the vessel 40 and supply tube 70.

Generally, the container can be used to thermally isolate a substance located in vessel 40, or otherwise separate two or more substances in a way that minimizes the total energy transferred as heat between an inner area of vessel 40 and an outside area of outer casing 20. This system can be made in a way that is far physically stronger and more stable than many current insulation systems with superior thermal insulation properties, and at the same time has orders of magnitude better thermal insulation than the best state of the art. Kevlar is an ideal material for manufacturing the strands 60.1, 62.1, 64.1, 60.2, 62.2, 64.2, because of its light weight, very high tensile strength, and its very low thermal conductivity. Other materials having similar properties can also be used. The very high tensile strength is necessary for some important features of container 10, as next discussed.

First, the high tensile strength of Kevlar permits relatively thin strands 60.1, 62.1, 64.1, 60.2, 62.2, 64.2 to hold a heavy load with vessel or tank 40 if arranged as a web explained above. Second, the higher the tensile strength of the material used for the strands, like Kevlar, the less of it is needed to hold two objects, being vessel or tank 40 and outer casing 20 at a constant distance. Strands that can be made very thin due to its very high tensile strength allowing to reduce the cross sectional area as seen in a longitudinal direction, that at the same time allows to reduce the thermal conductance. Kevlar, having exceptional tensile strength of around 3000 MPa and light weight with a relative density as compared to water of 1.44, make it a preferred choice for manufacturing the strands. In this respect, even though Kevlar has a tensile strength higher than steel, it has an extremely low thermal conductivity, near the low end of the existing thermal conductivities of any known material at 0.04 W/m-K, whereas the thermal conductivity of steel ranges from approximately 10/m-K-60 W/m-K. Therefore, by holding vessel 40 inside outer casing 20 with strands 60.1, 62.1, 64.1, 60.2, 62.2, 64.2, and by evacuation the inner space 30 to create substantial vacuum therein, it creates an insulation system that has superior insulation characteristics, mechanical strength, and reduced weight as compared to conventional insulation system.

The proposed web insulation system with the special arrangement of strands 60.1, 62.1, 64.1, or 60.2, 62.2, 64.2 and the vacuumized space 30 in which strands are located has many advantages over the conventional systems. As explained above, the thermal insulation properties of the web insulation system are several orders of magnitude better than comparable conventional systems. The only solution that could be possibly compared in its performance having similar insulation properties would be a system that is substantially more expensive and more complex, and having a very low tolerance in its manufacture, such as the insulation system incorporated in the Gravity Probe B satellite experiment of 2004 of the National Aeronautics and Space Administration (NASA) and Stanford University. It can also be a replacement to the classic Dewar design in that it may present superior insulating properties having exceptional physical strength, light-weight, and simple design. Compared to the classic Dewar design, it has at least a comparable strength, but is a far superior insulator. The web insulation system also has a very low material cost, and a low cost of manufacture.

Widespread use of the web insulation system could also drastically increase the ease of handling for cryogenic materials, and the time limit for using cryogen after delivery and storage in tanks, currently very short, could be substantially increased. With the proposed web insulation system this time limit can be substantially increased and therefore will make most applications far easier and more efficient. It is known that the cooling to create and preserve the cryogen takes a large amount of energy, thus any cryogen lost is a large waste of energy and therefore cost. Similarly, actively cooling a cryogen to keep the cryogen at the critical temperature can be very energy intensive, and is necessary when insufficient insulation is used, or sufficient time has passed. Effectively removing this time limit severely lowers the cost of creating, storing, and using a cryogen because there is little lost due to poor insulation.

Therefore another advantage of the present web insulation system is substantial cost saving for cryogenic applications, because one of the most important factors in the price of liquid nitrogen are transportation costs associated to losses of liquid nitrogen during transportation from the distributor to the consumer. Also, substantial costs are spent by researchers and hospitals as their expensive cryogens succumb to ambient heating during storage. Currently, the price of liquid nitrogen is about $0.55/liter, and even in a relatively short transportation time, much liquid nitrogen can be lost that will result in a substantial price increase. These costs are substantially reduced when using the proposed container 10 for transporting liquid nitrogen, because the liquid nitrogen losses during transport are negligible. These savings on transport costs and storage costs would be even more obvious if more expensive liquids were transported, for example liquid helium at about $4/liter. Also, the weight of container 10 is more or less the same as the weight for conventional dewars, thereby not increasing transportation costs that are related to the weight of transported goods, for example for aerial or space transportation.

The low material cost, manufacturing costs, and severely reduced energy costs when operating the proposed web insulation system lead to a strongly reduced overall cost in using cryogens in any way. This should lower the cost of purchasing cryogenic material, and create an increased market niche for making insulation systems in general, with a significant portion of that niche relating directly to the present web insulation system.

Figure 5:
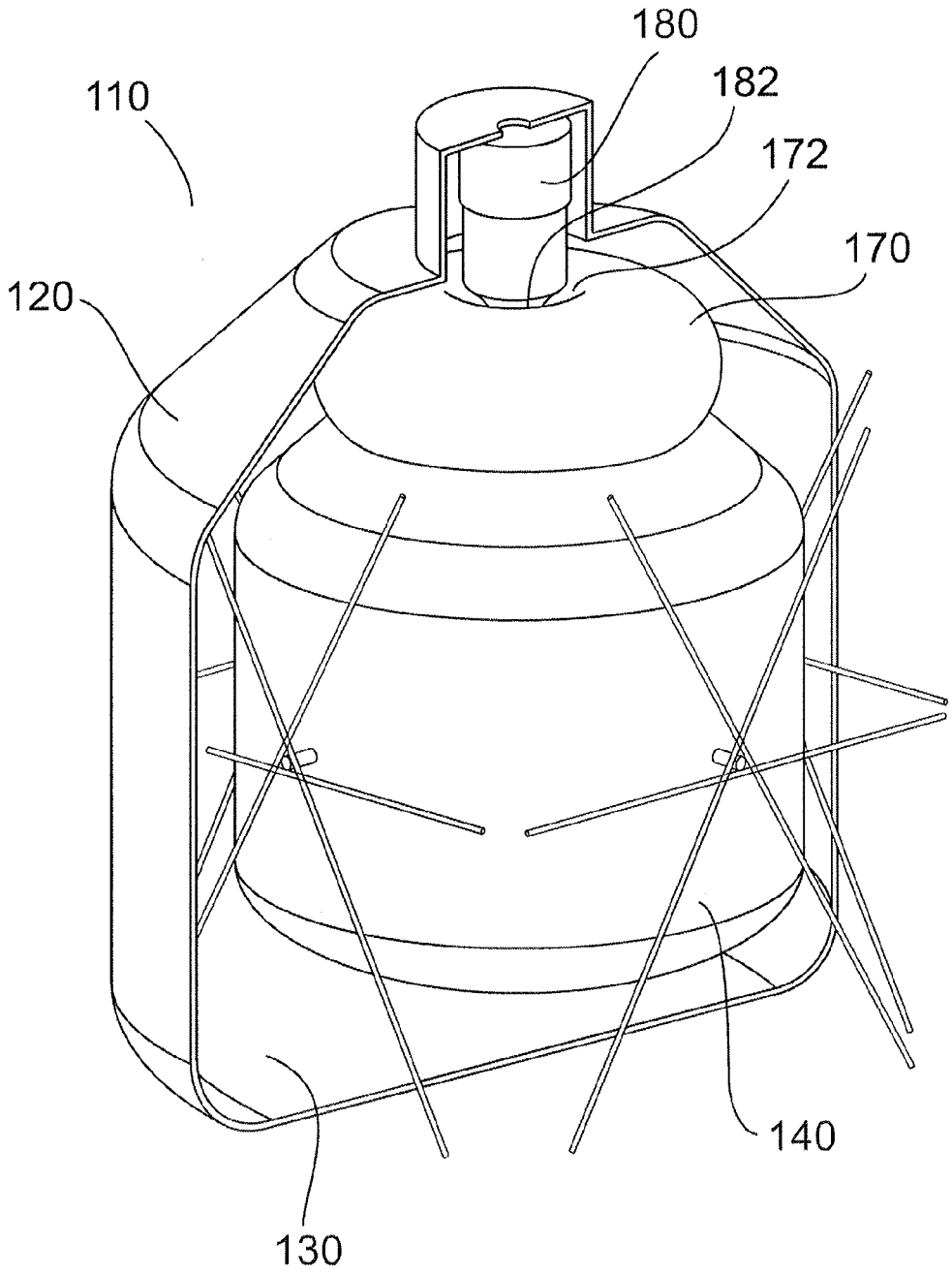
FIG. 5 shows a perspective schematic cut out view of a storage container using the web insulation system according to another embodiment.

FIG. 5 depicts an additional embodiment of the container 110 using the above described insulating system, having outer casing 120, inner space 130, and vessel or tank 140, and probe-and-drogue docketing element. Vessel 140 has an upper part that is formed as a rounded lip 170, having a toroid shape, and having a conical opening area 172, forming a drogue, for docketing with a probe 180 having a tip 182 with a complementary shape to opening area 172. The probe 180 is movable and has two (2) positions: extended and retracted. The movement can be performed by an actuator that is located in the neck of outer casing 120. (Not shown). When the probe 180 is in it is extended position, a connection between the exterior atmosphere and the vessel or tank 140 is established, enabling inserting or evacuating liquids from vessel 140. When the probe 180 is in it is retracted position, for example during long-term storage, the probe 180 is retracted from the rounded lip 170 in the z-direction and stowed. Also, when in it is retracted position, the probe 180 is physically disengaged from the rounded lip 170 and the vessel 140, and the only connection between outer casing 120 and vessel 140 is the very small surface area between protrusions 50.1, 50.2 and the filamentary strands 60.1, 62.1, 64.1, 60.2, 62.2, 64.2. No physical connection is present between probe 180 and drogue formed by lip 170 and conical area 172.

Figure 6A:
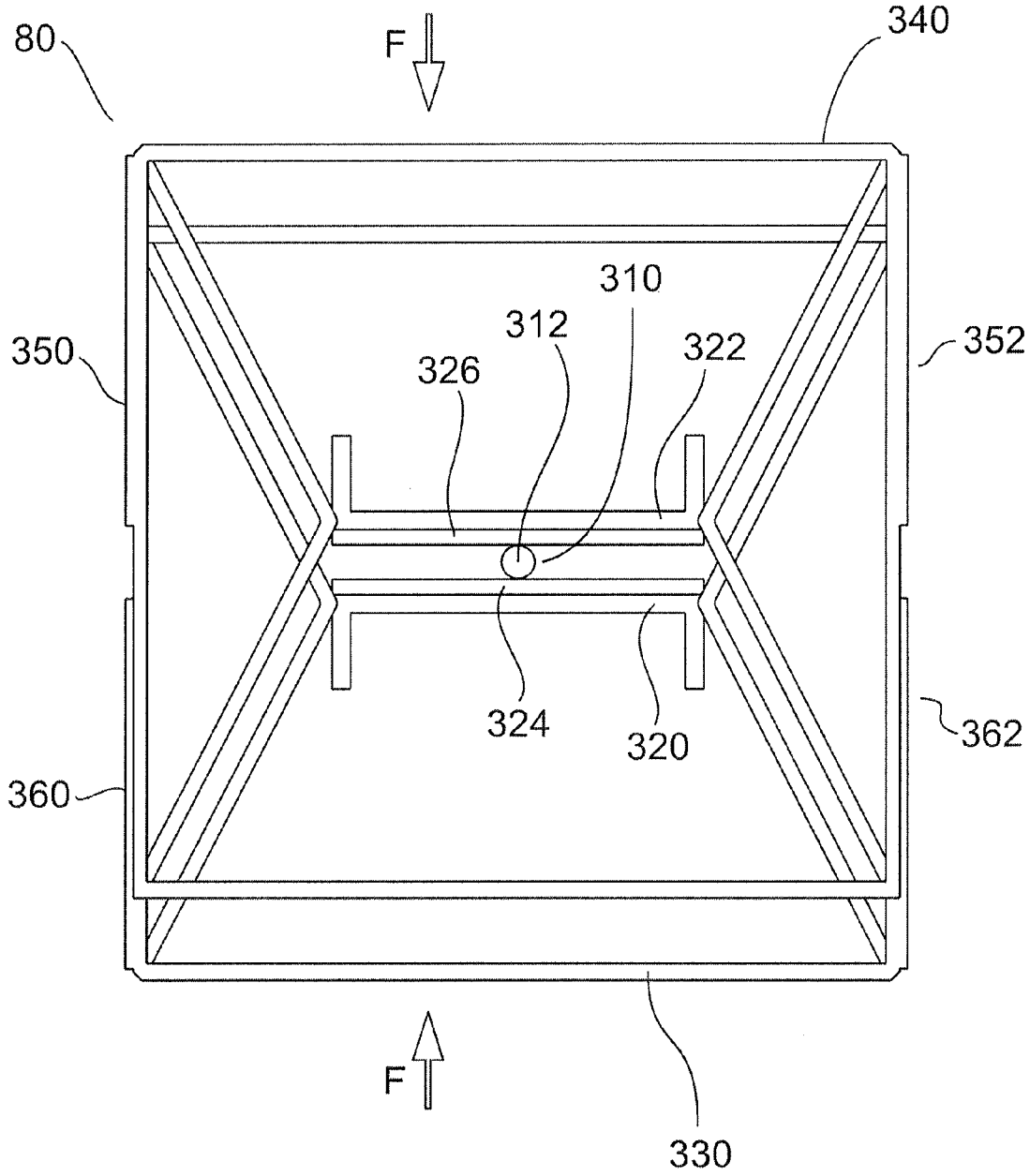
FIG. 6A shows a frontal plan view of a valve system.
Figure 7:
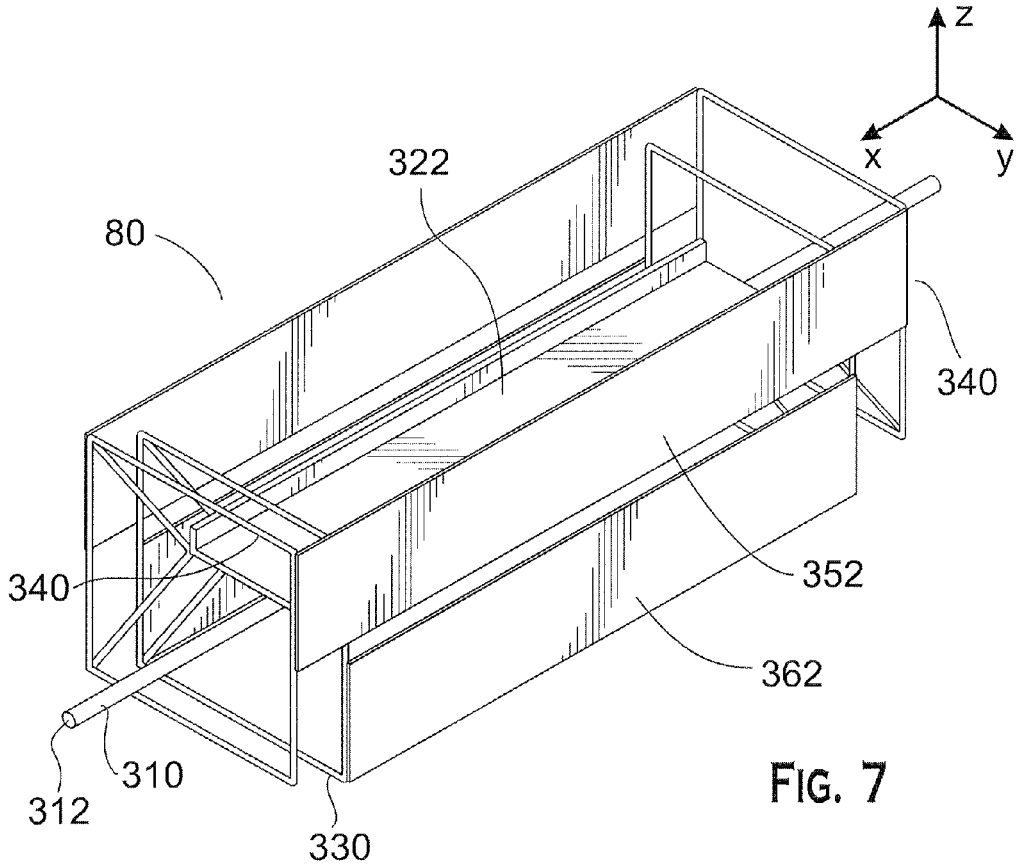
FIG. 7 shows a top perspective view of a valve system according to another embodiment.

FIGS. 6A and 7 depicts two different views of a valve system 80 according to another aspect of the present invention, that can be used with the above described web insulation system. FIG. 6A depicts valve system 80 from a view towards a longitudinal axis of tube 310 that serves to connect vessel or tank 40 with the exterior, and FIG. 7 shows a perspective view of the valve system. Valve system 80 can be placed in an upper portion of casing 10, for example in the neck part as shown in FIG. 1, and can be operated by contractible and expandable filamentary strands that are attached to the inner surface 24 of casing 20. Tube 310 is made of a flexible material that can be compressed and expanded in the z-direction by the clamping together of flexible padding 324, 326, so that an inner channel 312 of tube 310 can be opened when expanded and sealed when compressed. As shown in conjunction with FIGS. 8A and 8B, tube 310 is supported by the upper and the lower side by a flexible padding 324, 326 that themselves are supported by upper and lower plates 320, 322, with flexible padding 324, 326 being thicker towards the center, so that a distance between the opposing surfaces of padding 324 and 326 decrease towards the center of padding 324, 326, when viewed in the x-direction.

A lattice or pressure structure having upper and lower frames 330, 340, with upper side walls 350, 352, lower sidewalls 360, 362, supporting plates 320, 322 for holding the flexible padding 324, 326, respectively, is arranged inside space 30. The pressure structure is configured such that upper and lower frames 330, 340 can be moved towards each other to compress the tube 310 for closing channel, and to release pressure on tube 310 to open channel 312, indicated by arrows F in FIG. 6A. A mechanism (not shown) can be arranged to exert a force at least one of upper frame 330 and lower frame 340 for exerting a pressure on flexible padding 324, 326 for closing and opening tube 310. For example, frames 330, 340 can be moved towards and away from each other along the z-direction by pulling strands that are attached to each frames 330, 340, and the strands can be pulled by a motor that is arranged inside casing 20. Also, frames 330, 340 can be pressed together by linear actuators such as linear motors, electro-mechanical actuators, piezoelectric actuators that can operate in vacuum of space 30, and are fixed to frames 330, 340, and the control and energy supply can be made wireless so that no external cables or connectors are required through casing 20. Also, frames 330, 340 and plates 320, 322 are constructed such that they are stiff enough to be able to be pressed against tube 310 to close channel 312. In a closed, compressed state, channel 312 of tube 310 is arranged such that no liquid or fluid from tank 40 can escape via tube 310.

Figure 6B:
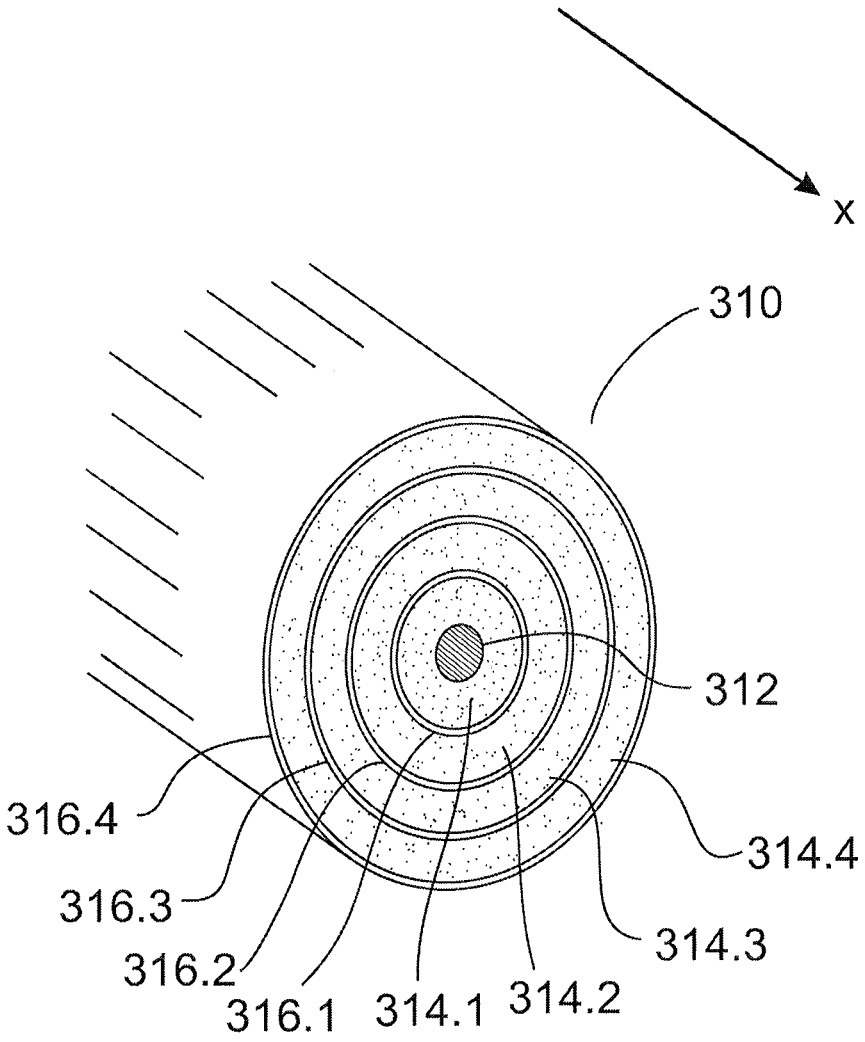
FIG. 6B shows a perspective cut view of the tube of the valve system according to another embodiment.

FIG. 6B shows a cut perspective view of an exemplary tube 310 that can be used for valve system 80. Tube 310 is preferably made of several layers of aluminized Mylar™ or Kapton™, with a channel diameter that allows for a sufficient flow rate. As an example, tube 310 can be made of concentric tubes 314.1, 314.2, 314.3, and 314.4 having an increasing diameter, and are in direct contact with each other. The direct contact between tubes 314.1, 314.2, 314.3, 314.4 needs to be firm to avoid leakages perpendicular to the x-direction, through the walls of the tube. Moreover, outer surface of tubes 314.1, 314.2, 314.3, 314.4, may be coated with protection layers 316.1, 316.2, 316.3, and 316.4, respectively. Concentric tubes 314.1, 314.2, 314.3, and 314.4 are preferably made of Mylar™ and protection layers 314.1, 314.2, 314.3, and 314.4 made of Aluminum (Al), such that Al is coated onto concentric tubes 314.1, 314.2, 314.3, 314.4 made of Mylar™, for example by vapor deposition. The multiple layers of tubes 314.1, 314.2, 314.3, 314.4 are arranged to provide for leakage redundancy in a radial direction of tube 312. Channel 312 is small enough in diameter that it can be squeezed by forces F for full closure. Preferably, the forces F that are applied to tube 312 exert a pressure in the range of 5-10 bar. In this variant shown, tube 310 consist of four layers, but it can be made by a different number of layers.

Figure 8A:
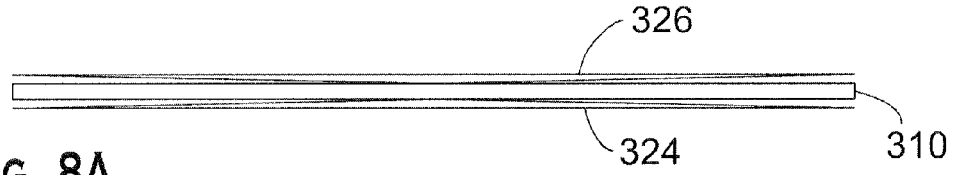
FIGS. 8A and 8B shows the tube of the valve system in an open and in a closed state.
Figure 8B:
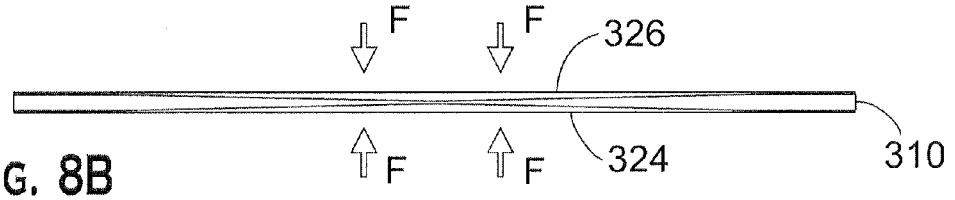

FIGS. 8A and 8B shows two different views of the flexible upper and lower padding 324, 326 when they are pressed against tube 310 to compress tube 310 in a z-direction, as referenced by the coordinate system of FIG. 7. FIG. 8A shows tube 310 in an open, decompressed state where channel 312 is open for tank access, and FIG. 8B shows tube 310 in a compressed state with channel 312 being closed. The purpose of the flexible and curved nature of flexible padding 324, 326 is to apply a slowly varying amount of pressure on the tube 310 starting from the center of the tube, and then smoothly pressing towards both extremities of tube 310 for a smooth action. For this purpose, the surfaces of flexible padding 324, 326 that faces the tube 310 have a cross-sectional profile along a longitudinal extension of tube having an apex substantially in the middle of padding 324, 326, and have slightly sloped surfaces towards the extremities of padding towards the positive and negative x-direction. Applying pressure in this manner slowly pushes toward the tube 310 towards both ends simultaneously, and thereby builds up a pressure that moves away from the center of tube 310 and gently presses any cryogen or liquid out of tube 310 to both extremities, minimizing the chance that tube 310 will crease. Also, tube 310 and channel 312 are formed out of a material and having a length in the x-direction that is sufficient to be superfluid-tight in a closed position, for example, the length of tube 310 can have length of 7 cm or more.

This mechanism of valve 80 is especially important to cope with cryogenic temperatures that are present in channel 312 of tube 310 and for the repeated opening and closing of a valve 80, and to prevent creasing that could create small cracks and holes in tube 310, allowing for leakage, reduction and even destruction of the vacuum of inner space 30. At cryogenic temperatures, many materials become brittle, and are more prone to wear and cracking with repeated and successive deformities of the structure. Therefore, creasing should be avoided because it can lead to leakages. This is especially important when dealing with superfluid cryogens, as they can easily leak through very small cracks on an atomic scale. Leaking cryogen into the inner space 30 would in turn lower the insulative properties of container 10 by compromising the vacuum. Frames 330, 340 and plates 320, 322 are preferably made of a stiff, lightweight material, that maintains its structural integrity at cryogenic temperatures for example aluminum, or a material having similar properties.

Figure 9:
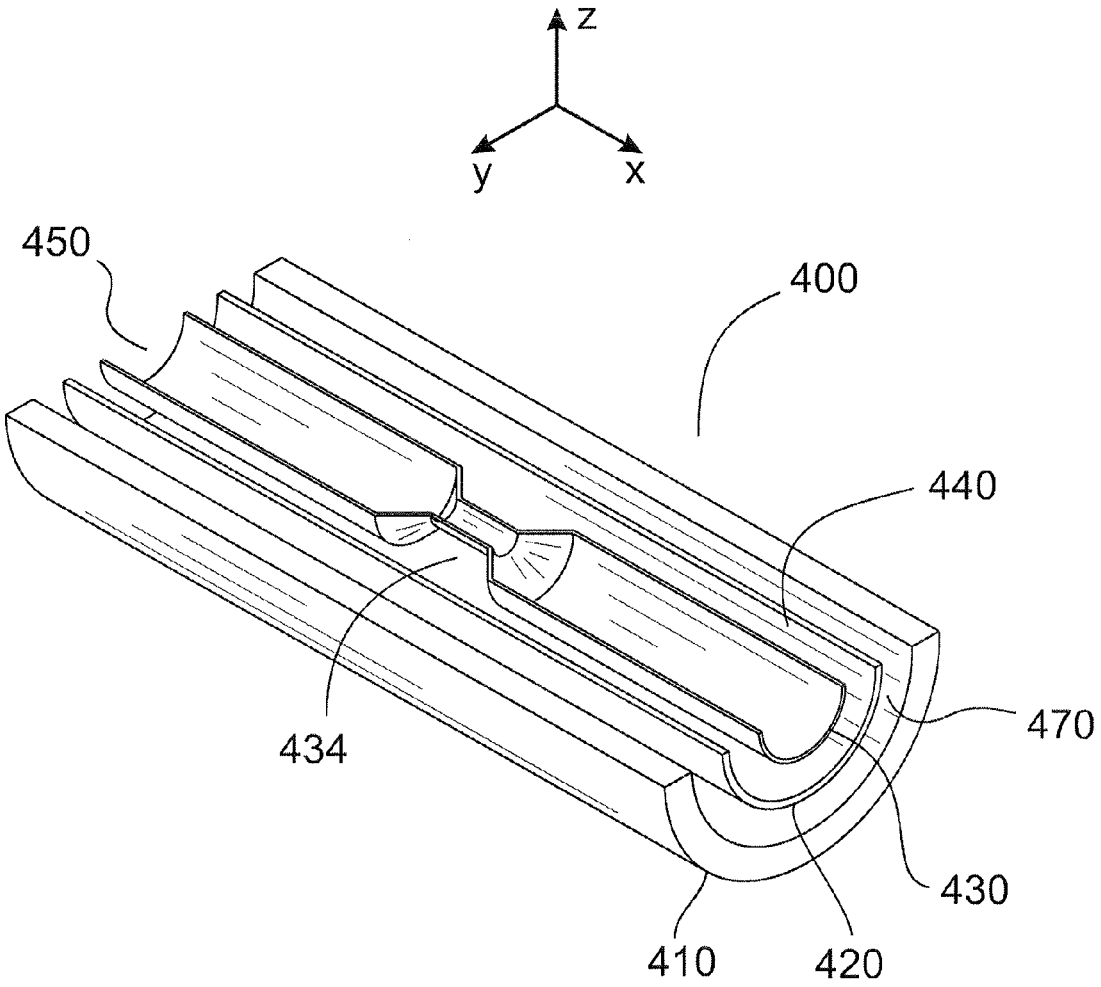
FIG. 9 shows a perspective cross-sectional view of a storage container using the web insulation system according to yet another embodiment.

FIG. 9 depicts a perspective cross sectional view of another embodiment of the present invention, being a cylindrically-shaped piping 400 that requires vacuumized insulation by intermediate space 440, having an outer casing 410, an intermediate shell 420, and an inner tube 430 having a narrowed portion 434. Piping 400 is usually used as conducts for superfluids, such as superfluid He. Narrowed portion is shown to have a cross-section with a bottom part extending in the longitudinal direction of the piping 400, and slanted side walls. However, in a variant the cross-sectional shape may be different, for example a v-shaped cross section. Cylindrically shaped container 400 can also be a part of the above-described container 10, for example as the supply tube 70 shown in FIG. 1. An inner space is formed inside inner tube 430, an intermediate space 440 is formed between inner tube 430 and intermediate shell 420, and an outer space 470 is formed between intermediate shell 420 and outer casing 410. Intermediate space 440 can be vacuumized to insulate inner space 450. A cryogen can be placed in the outer space 470, or the outer space can be evacuated and vacuumized to act as an additional insulation space, insulating the intermediate shell 420, and thereby further decreasing the thermal conduction to the inner space 450. Thereby two evacuated structures are established, the intermediate space 440 and outer space 470 for improved insulation and redundancy. Preferably, outer casing 410, intermediate shell 420, and inner tube 430 are made of stainless steel. Instead of vacuumizing intermediate space 440, it can also be filled with cryogen, so that the temperature of intermediate shell 420 can be lowered. This can be useful because it holds intermediate shell 420 at a low temperature at about ~70K for $LN_2$, which is colder than the half way between the atmosphere and the cryogen (70K< (300K-2K)/2, in a case in which the external atmosphere is colder than ~140K, for example in space. Inner tube 430 can be suspended by filamentary strands that are lodged into narrowed portion 434, so that no protrusions are required.

Figure 10:
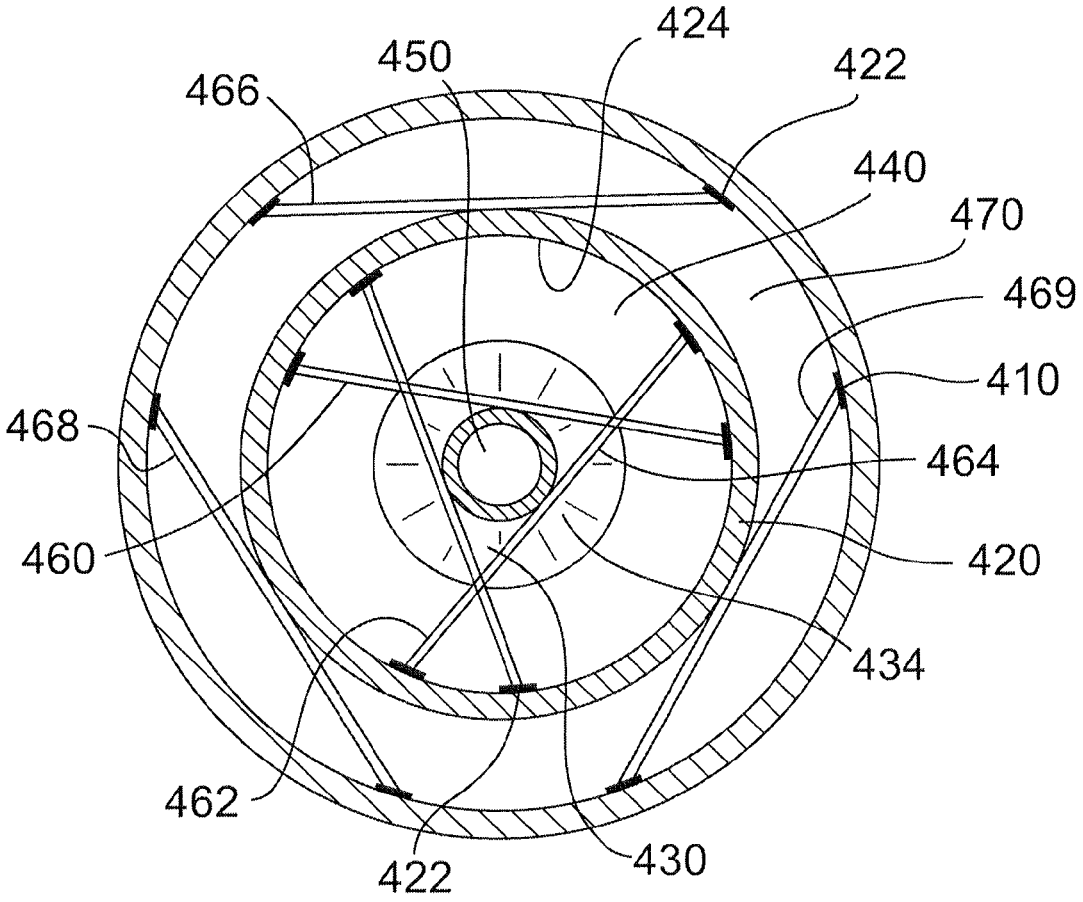
FIG. 10 shows a frontal cross-sectional view of a storage container using the web insulation system according to yet another embodiment.

FIG. 10 depicts a cross-sectional view of the cylindrically-shaped container 400 in a direction of the x-axis in a direction of longitudinal expansion of the container 400. Three filamentary strands 460, 462, and 464 are attached to an inner surface 424 of the intermediate shell 420, and are arranged around tube 430 to tangentially touch tube 430. However, tube 430 can also have protrusions (not shown) to reduce the contact surface between strands 560, 462, 464 and the inner tube 430. Also, tube 430 may have narrowed portions 434 as explained in FIG. 9 for lodging strands 460, 462, and 464. In outer space 470 between the outer casing 410 and the intermediate shell 420, additional strands 466, 468, 469 are arranged that also tangentially touch the intermediate shall 420 to hold it at a fixed position. Also, protrusions or narrowed portions can be arranged on an outer surface of intermediate shell 420 for holding strands 466, 468, 469. Preferably, the attachment points 422 of the inner strands 460, 462, 464 and the tangential touch points for outer strands 466, 468, 469 are at different radial locations on intermediate shell. Intermediate space 440 is evacuated to be substantially in vacuum and outer space 470 can be either evacuated to be substantially in vacuum or filled with another cryogen depending on the situation so as to provide maximal thermal insulation, as explained above.

Figure 11:
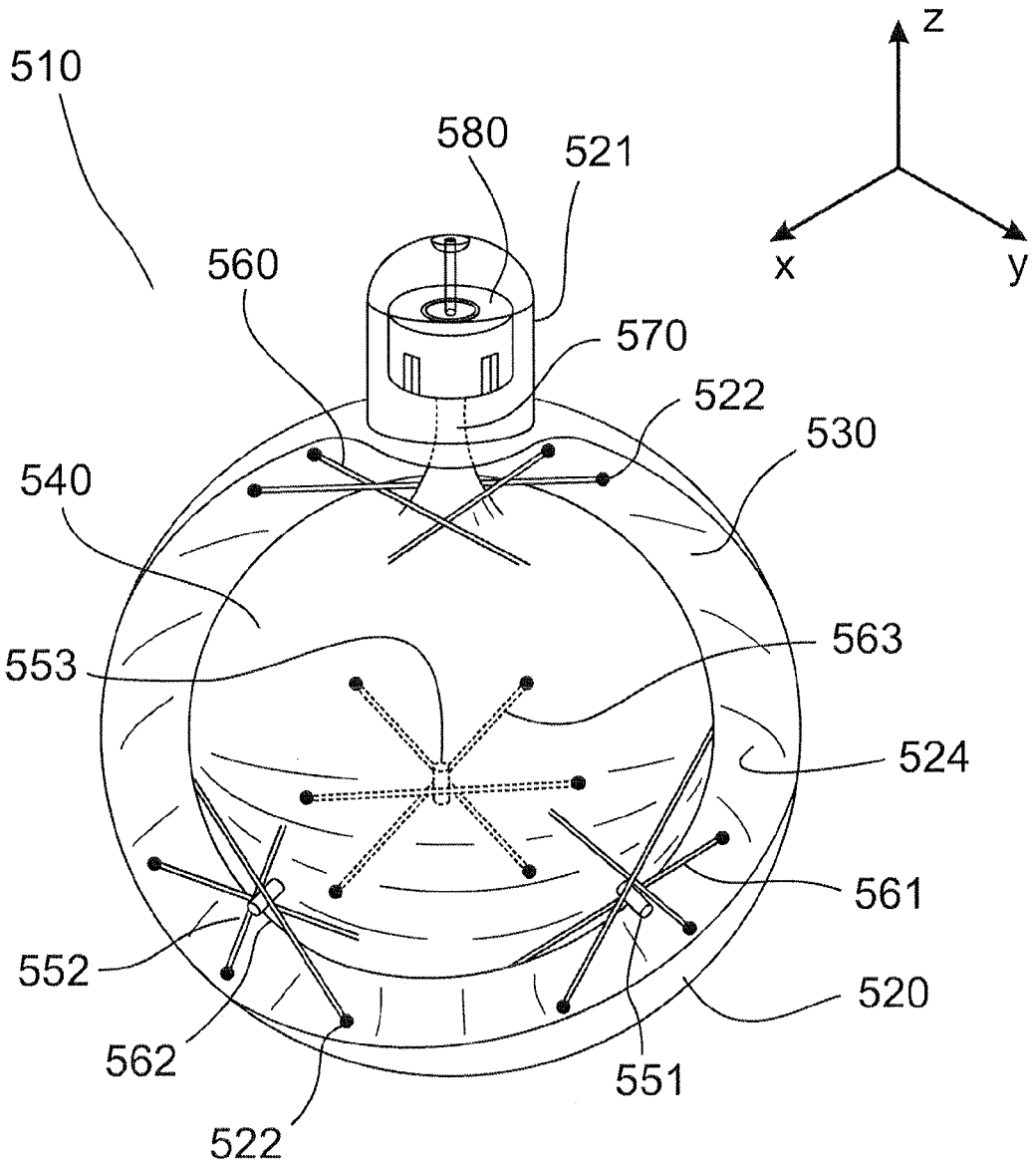
FIG. 11 shows a perspective schematic cut out view of a storage container using the web insulation system according to still another embodiment.

FIG. 11 depicts a perspective schematic cut out view of a storage container 510 using the web insulation system according to another embodiment, in which the inner volume 530 is substantially spherical, but for the supply tube 570. Moreover, outer casing 520 is also substantially spherical with exception of neck 521, and is concentrically arranged to inner volume 530, and outer casing 520 is formed with a larger radius than inner volume 530. A vacuumized space 530 is formed therebetween. For descriptive purposes, outer casing is shown to be cut open. Inner volume 530 has three protrusions 551, 552, and 553 that are arranged equidistantly to form a triangle at the same latitude of the sphere formed by inner volume 530. Each protrusion 551, 552, and 553 is associated with a group of three filamentary strands 561, 562, and 563 that are arranged in a star configuration having an angle of 120° between each other, with the ends of the strands attached at specific connection points 522 at inner wall 524 of outer casing 520. As described above with respect to FIG. 1, each of the strands of groups 561, 562, 563 is strongly tensioned, and an intermediate point along the strand is tangentially touching the side wall of protrusions 551, 552, 553, respectively, that are formed in a cylindrical shape.

Next, supply tube 570 is arranged to protrude upwards in z-direction for providing and delivering stored content of storage container 510, and protrudes concentrically into neck 521 of outer casing. A valve system 580 is also arranged inside neck for opening and closing access. For lateral stabilization of inner volume 540 inside outer casing 520, another group of filamentary strands 560 are arranged around supply tube 570 on a horizontal x-y plane, also in a star configuration. Instead of having a protrusion associated with group 560 of strands, the strands are arranged to touch side walls of supply tube, and an upper surface of inner volume 530. Thereby, strands 560 are configured to stabilize volume 530 against lateral movements and accelerations, but also to hold inner volume 530 at its place along the z-direction. Also, while group of strands 561, 562, and 563 have the function of carrying the weight of volume 530, group of strands 560 are merely for stabilization purposes. Therefore, stands of group 560 can be made thinner than strands of groups 561, 562, and 563. Also, for additional weight and thermal insulation purposes, because the horizontal strand of the groups 561, 562, and 563 carries most of the weight, these three stands can be made thicker than the other two strands of the group.

The present invention has been described herein in terms of several preferred embodiments. However, modifications and additions to these embodiments will become apparent to those of ordinary skill in the art upon a reading of the foregoing description. It is intended that all such modifications and additions comprise a part of the present invention to the extent that they fall within the scope of the several claims appended hereto. Like numbers refer to like elements throughout. In the figures, the thickness of certain lines, layers, components, elements or features may be exaggerated for clarity.

The terminology used herein is for the purpose of describing particular embodiments only and is not intended to be limiting of the invention. Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the specification and relevant art and should not be interpreted in an idealized or overly formal sense unless expressly so defined herein. Well-known functions or constructions may not be described in detail for brevity and/or clarity.

As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items. As used herein, phrases such as "between X and Y" and "between about X and Y" should be interpreted to include X and Y. As used herein, phrases such as "between about X and Y" mean "between about X and about Y." As used herein, phrases such as "from about X to Y" mean "from about X to about Y."

It will be understood that when an element is referred to as being "on", "attached" to, "connected" to, "coupled" with, "contacting", etc., another element, it can be directly on, attached to, connected to, coupled with or contacting the other element or intervening elements may also be present. In contrast, when an element is referred to as being, for example, "directly on", "directly attached" to, "directly connected" to, "directly coupled" with or "directly contacting" another element, there are no intervening elements present. It will also be appreciated by those of skill in the art that references to a structure or feature that is disposed "adjacent" another feature may have portions that overlap or underlie the adjacent feature.

Spatially relative terms, such as "under", "below", "lower", "over", "upper", "lateral", "left", "right" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is inverted, elements described as "under" or "beneath" other elements or features would then be oriented "over" the other elements or features. The device may be otherwise oriented (rotated 90 degrees or at other orientations) and the descriptors of relative spatial relationships used herein interpreted accordingly.

The invention claimed is:

1. A storage system, comprising:

an outer casing having an evacuated inner volume;

a vessel for storage located within the outer casing and having a plurality of protrusions distributed on an outer surface thereof; and a plurality of filamentary strands spanning the inner volume, wherein at least some of the plurality of protrusions are essentially tangentially contacted by the plurality of the filamentary strands to secure the vessel in six degrees of freedom relative to the outer casing, and wherein the filamentary strands have a thermal throughput from the vessel to the outer casing being no greater than 5 mW/liter of liquid nitrogen.

2. The storage system according to claim 1, wherein the filamentary strands are in tension.

3. The storage system according to claim 1, wherein the filamentary strands are formed from at least one of Kevlar and Basalt fiber.

4. The storage system according to claim 1, wherein the filamentary strands have a cross section that allows to decrease thermal conduction between the outer casing and the vessel.

5. A thermal insulation device, comprising:

an outer shell exposed to an exterior area;

a storage container located inside the outer shell;

a substantially vacuumized area between the outer shell and the storage container; and suspended filamentary strands located inside the vacuumized area, each filamentary strand having a first end and second end, wherein the first end and the second end of each filamentary strand is attached to an inner side of the outer shell to be suspended so that each filamentary strand holds the storage container at a position, and wherein the filamentary strands have a thermal throughput from the vessel to the outer casing being no greater than 5 mW/liter of liquid nitrogen.

6. The thermal insulation device according to claim 5, further comprising:

protrusions attached to an outer surface of the storage container, wherein each filamentary strand engages with a corresponding protrusion for holding the storage container.

7. The thermal insulation device according to claim 5, wherein each of the filamentary strands does not contact an outer surface of the storage container.

* * * * *